US005971218A

United States Patent [19]

Le

[11] Patent Number: 5,971,218

[45] Date of Patent: Oct. 26, 1999

[54] FOOD AND BEVERAGE DISPENSER WITH A DYNAMIC SEAL

[75] Inventor: Johannes Le, Huntington Beach, Calif.

[73] Assignee: Cambro Manufacturing Company, Huntington Beach, Calif.

[21] Appl. No.: 09/041,574

[22] Filed: Mar. 12, 1998

[51] Int. Cl.[6] ..... B67D 5/06; B67D 5/62; F25D 3/08; B65D 53/00

[52] U.S. Cl. ..... 222/185.1; 222/153.01; 222/146.1; 62/440; 62/457.1; 62/457.4; 220/337; 220/344

[58] Field of Search ..... 222/185.1, 153.01, 222/146.1; 62/457.1, 457.4, 440; 220/315, 334, 344, 337

[56] References Cited

U.S. PATENT DOCUMENTS

| | | | |
|---|---|---|---|
| D. 318,395 | 7/1991 | Juergens | D7/311 |
| D. 403,916 | 1/1999 | Le | D7/306 |
| D. 403,917 | 1/1999 | Le | D7/306 |
| 3,308,636 | 3/1967 | Schaaf | 62/400 |
| 4,775,072 | 10/1988 | Lundblade et al. | 220/94 R |
| 5,024,471 | 6/1991 | Kahl et al. | 292/97 |
| 5,125,697 | 6/1992 | Kahl et al. | 292/204 |
| 5,224,635 | 7/1993 | Wise | 222/608 |
| 5,605,056 | 2/1997 | Brown et al. | 62/457.4 |

*Primary Examiner*—Kevin P. Shaver
*Assistant Examiner*—Keats Quinalty
*Attorney, Agent, or Firm*—George F. Bethel

[57] ABSTRACT

A food and beverage container having a lid and a base portion with four upright walls and a bottom. The lid seats on the base portion, and is secured by a pivoting latch handle with a hook portion hinged to the handle. The hook portion has a width where it contacts the lid equal to or greater than its length. The base portion and lid are sealed by an elongated elastomeric member seated in a groove of the lid.

14 Claims, 2 Drawing Sheets

FOOD AND BEVERAGE DISPENSER WITH A DYNAMIC SEAL

BACKGROUND OF THE INVENTION

1. Field of the Invention

The field of this invention is within the food and beverage dispenser art. In particular, it relates to those food and beverage dispensers which generally have a spigot for dispensing beverages as well as in some cases soup and other liquid type foods.

2. Background of the Invention and Prior Art

The prior art with regard to food and beverage dispensers incorporates various dispensers. Many of them have lids or covers which seat on top of the dispenser. However, it is not known to date that any such dispensers incorporate an elongated over center latch handle which functions with a dynamic seal.

This invention particularly provides for an over center broad elongated latch handle which seals the entire container. The container is sealed by virtue of a dynamic seal in the form of an O ring or other suitable elastomeric member that is within a groove surrounding the lid or cover. The groove surrounding the lid holds the dynamic seal and merges it against a chamfered or other surface on the base portion container edges.

The net effect is to-provide for a seal and an over center latch which seals the top to the container in a tight and well insulated manner.

SUMMARY OF THE INVENTION

In summation, this invention comprises a food and beverage container which can dispense its contents through a spigot and has a top which is dynamically sealed to the base through a dynamic seal and elongated over center latch.

More particularly, it incorporates an insulated base container having four side walls and a bottom. The top is open and receives a cover or lid overlying it.

The cover or lid is received on the top edges. Surrounding the cover on the interior surface is a groove and lip which seats against the side walls of the base portion. The groove and lip, receive a dynamic elastomeric seal which seats against the interior of the side walls of the bottom portion and creates a seal for the container for both thermal and sanitary purposes.

The top is secured by means of an elongated plastic latch and handle which provide for an over center gripping of a flange and groove area on the top of the container. Both the latch and handle are wider than their top to bottom length. This helps to assure a seal with only one latch and handle on either side.

The handle is provided for the over center latch with an elongated gripping surface and pressing surface so that it can be easily pushed downwardly and pulled upwardly in order to respectively secure and unsecure the over center latch.

In order to facilitate carrying of the dispenser, the lower base portion of the container is provided with handles which are molded therein.

DESCRIPTION OF THE PREFERRED EMBODIMENTS

Figure 1:
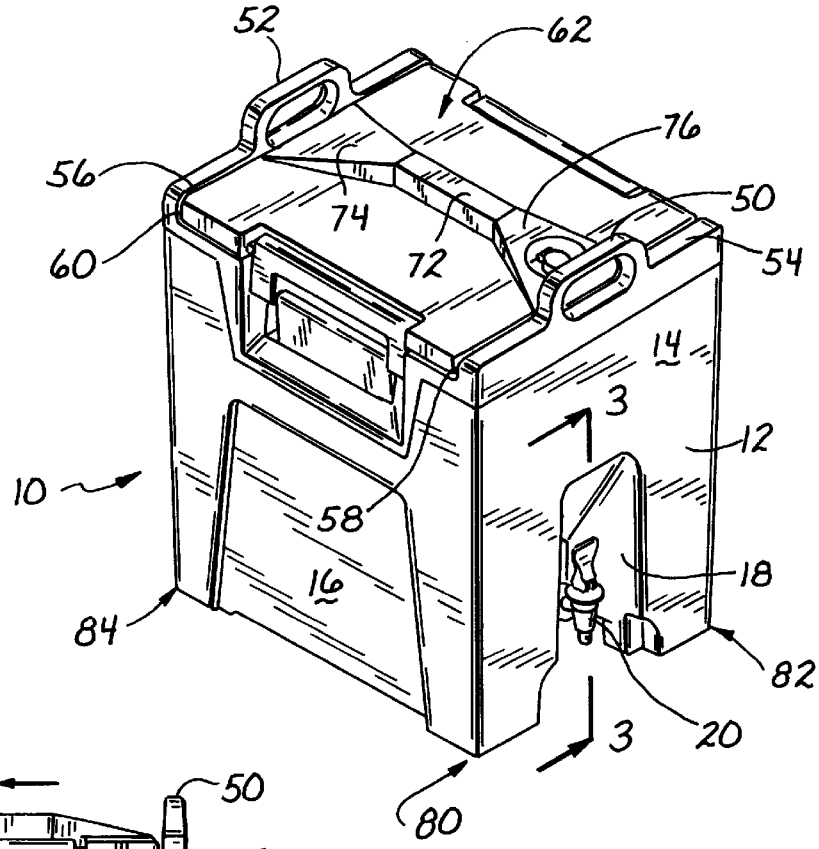
FIG. 1 shows a perspective view of the food and beverage dispenser of this invention.

Looking more specifically at FIGS. 1 through 6, it can be seen that in FIG. 1 the food and beverage dispenser is shown in the form of a container generally shown as container 10. The container 10 includes a base portion 12 having an end wall 14, a side wall 16 and a bottom 17. The side wall 16 is emulated on the opposite side in symmetrical relationship.

The end wall 14 is not the same as the end wall on the opposite which is not shown. In particular, end wall 14 includes a recess 18 with a spigot 20. The spigot 20 is mounted within the end wall 14 by means of a round flanged nipple 22 seated to an extension 24 threaded on by a nut 26. The spigot 20 has an outlet 28 that is valved by a handle 30 which opens up an interior valve of the spigot 20. In this manner, food and beverages can be dispensed from the interior of the lower or base portion of the container 10. The container 10 includes an interior void 34 of the lower base portion of the container 10 surrounded by the side, end walls, and a base portion.

The base portion 12 of the container 10 has its base or a bottom wall 17 formed with the side and end walls respectively 16 and 14 and their opposite counterparts in a double walled construction. In particular, it can be seen that an interior wall 40 is shown interiorly of the wall construction of the base 12 of the container 10 that has a generally matching counterpart 42 on the exterior thereof.

The two respective walls 40 and 42 have a foam insulating material 46 therebetween. The foam insulating material 46 is foamed in place in order to provide for insulation.

The end walls 14 and the opposite wall thereto terminate in a pair of handles 50 and 52 that extend upwardly from the end wall 14 and the opposite wall. The handles 50 and 52 are molded into the terminal side wall top end portions 54 and 56 that respectively provide for an interior seat 58 and 60 at either end. The interior seats 58 an 60 allow for a lid 62 to be emplaced and held thereon. The lid 62 is formed as a double walled upper lid portion 64 with a lower walled portion 66 which seats interiorly within the bottom container side walls.

The top lid also has a reinforcing rib 72 which extends across the top and terminates into two sloping expanding portions 74 and 76. The base container portion 12 incorporates corner portions 80, 82 and 84 as well as one that is not seen on the far side formed by the termination of the end wall 14 and the side wall 16 and their opposite counterparts. These corner portions 80, 82 and 84 provide feet which can be seen more readily in FIG. 2 upon which the base container portion 12 is seated.

Figure 4:
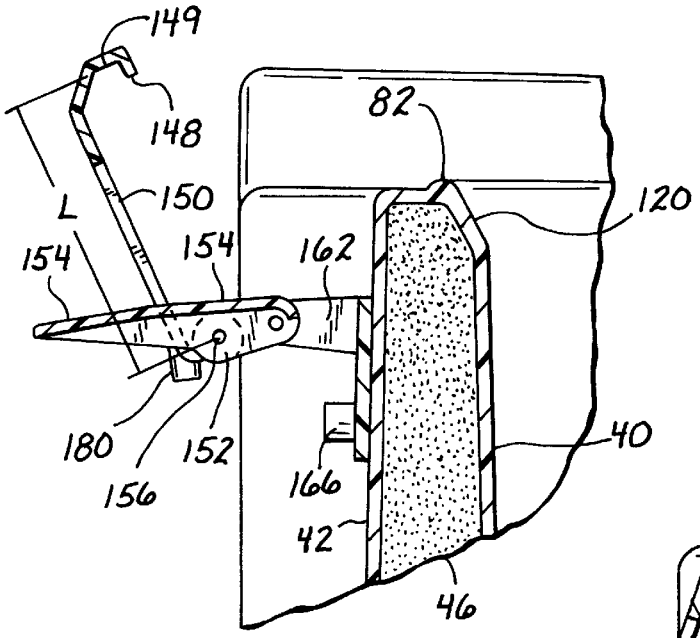
FIG. 4 shows a sectioned view of the wall of the container and the latch and handle as they are in their midpoint operating position.
Figure 5:
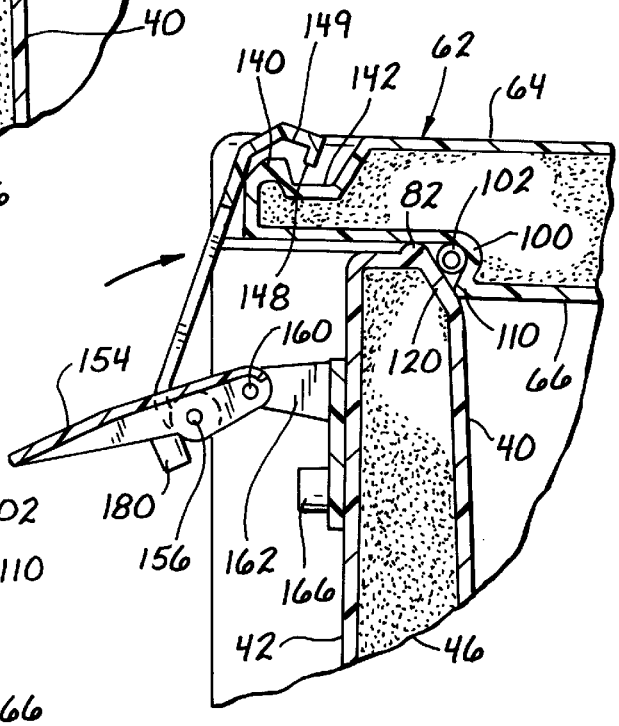
FIG. 5 shows a sectional view of the latch moving over center of the lid flange ready to engage the flange and groove of the lid.
Figure 6:
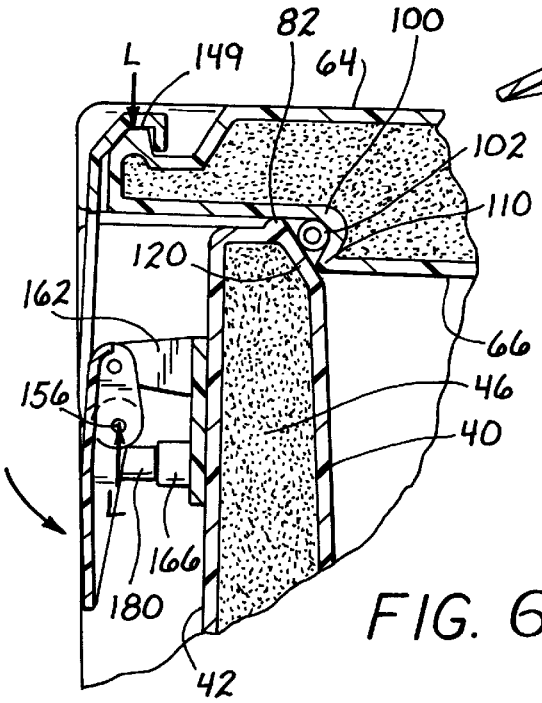
FIG. 6 shows the handle and the latch moved inwardly into locking engagement in the position shown along lines 6—6 of FIG. 2.

Looking more specifically at FIGS. 4, 5 and 6, it can be seen in FIG. 4 that only the base container portion 12 is shown. The top of the walls of the base container portion surrounding it in the entirety are provided with a rounded upstanding flange 82. The upstanding flange 82 receives the bottom surface 66 of the top 62 there against. This bottom surface of the top 82 lies thereon and helps to provide a seal with a dynamic seal which will be described hereinafter.

The top 62 is also provided with an interior groove 100 which surrounds the periphery of the bottom portion 66 of the lid 62. Within this groove 100 is an elastomeric O ring like member formed as an elongated elastomer 102. The elongated elastomer can be a hollow round tubular continuous member or any other dynamic type of seal. In effect, the elastomeric seal 102 that stretches around the groove 100 is provided which can be an elongated tubular elastomeric member that is continuously stretched around the groove 100 and is secured thereto by its natural elastomeric nature. This natural elastomeric nature causes it to seat within the rounded portion of the groove and at the same time be compressible when it engages the top wall of the base portion wall comprising walls 14 and 16 and their opposite counterparts. A further point to note is the seal 102 is formed as a hollow tube providing a dynamic compressible interior sealed air cushion.

The top lid 62 also has a projecting flange 110 which serves to receive a portion of the seal 102 therein and at the same time provide for contact along with the seal 102 against a sloping or flanged chamfered surface 120 of the interior wall 40 of the base container portion 12. The interior chamfered surface 120 extends all the way around to the side wall 16 and its opposite counterpart, and end wall 14 and its opposite counterpart and extends all the way around the surfaces thereof. In like manner, the groove 100 extends around the interior of the top, cover or lid 62 as well as the flange 110.

The lid 62 has a gripping flange 140 standing up from a groove 142 that is along the upper surface of a portion of the lid 62. The flange 140 in turn receives a hooked member or overturned portion 148 of a hook that is received therein upon latching. The hook 148 is basically configured in an interior manner to be received on the top of a flange 140 with the chamfered and interior surfaces as shown. However, it can be in any suitable form with respect to either a rounded, rectangular, triangular, circular, ogive or variable arcuate surface.

The hook 148 extends downwardly with an arm 150 and has a rounded cylindrical portion 152. The rounded cylindrical portion 152 is seated within a handle portion 154 by means of a pin 156. Pin 156 connecting the handle portion 154 allows for connected latching movement. The handle in turn is connected by a pin 160 to a bracket 162 in like manner at either end. Bracket 162 is connected to the side wall 42 by means of a pad 164 that has a bumper member 166 molded therewith.

Upon articulated movement, the lid 62 when placed on the lower base container 12 is hinged over center so the hook 148 engages and overlies the interior of the groove 142. This is shown in the direction of the arrow in FIG. 5.

When the handle 154 is moved downwardly in the direction of the arrow shown in FIG. 6, it causes the hook 148 to engage the lower surface 142 and the flange 140 in a tightened position. This provides an over center latching that is provided with resiliency by the seal of the elastomeric rounded tubular member 102 extending around the interior of the lid 62. Upon seating downwardly as shown in FIG. 6, the handle is received against the bumper 166 by virtue of its engaging contactor 180 that can be seen against the bumper 166 when seated in FIG. 6.

As can be seen at this point, the entire container with the base portion 12 and the lid 26 are sealed in sealed relationship as shown in FIG. 6. This not only provides for insulated maintenance of the contents in the void 34 of the base portion 12, but also allows for a dynamic seal through the elastomeric portion 102 for thermal as well as sanitary sealing.

Figure 2:
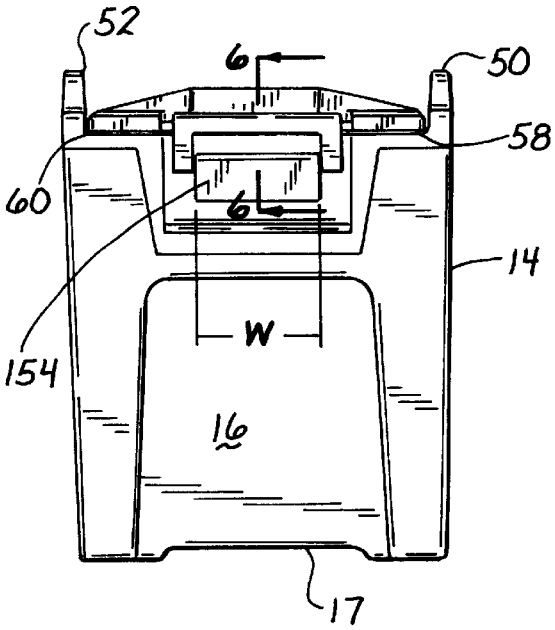
FIG. 2 shows a side elevation view of the food and beverage dispenser looking from the left side of FIG. 1.
Figure 3:
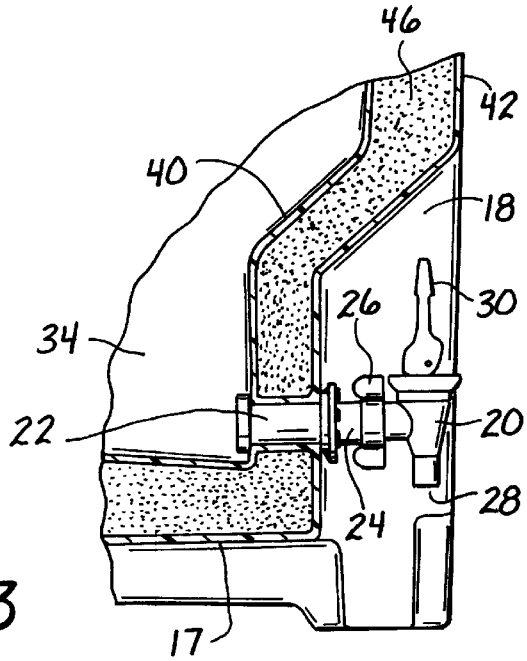
FIG. 3 shows a sectional view sectioned along lines 3—3 of FIG. 1 showing the spigot in its positioned relationship within the wall of the container.

The handle 154 and hook portion 148 as to its width W, shown in FIG. 2 should extend extensively along the length of the flange 140 and groove 142. This is to provide a single broad tight clamping sealing member. It has been found that the hook 148 contact surface 149 along width W should have a width W equal to or greater than the length L as to the height of the interior 149 of hook 148. Length L is shown as length L in FIG. 4 or along the length of lines L—L in FIG. 6 from the center of pin 156 to the interior surface 149 of the top of the hook 148. In this manner a broad sealing contact is provided.

As can be seen from the foregoing, this invention is a substantial step over the prior art of sealing lids for food and beverage dispensers.

I claim:

1. A food and beverage container having a lid and a base portion for containment of food and beverages therein comprising:

a base portion having four upright walls and a bottom portion;

a lid for seating on said base portion;

a groove on the interior surface of said lid;

an elastomeric seal within said groove for sealing between said lid and base portion;

a latch for latching said lid to said base portion having a hook portion pivotally hinged to an operating lever that is pivotally mounted to one of said upright walls; and, a spigot within at least one upright wall of said base portion for dispensing liquid contents of said base portion.

2. The container as claimed in claim 1 wherein:

said seal comprises an elastomeric member of circular cross-section extending around the interior of said lid.

3. The container as claimed in claim 2 further comprising:

said seal having a hollow interior cross-section.

4. The container as claimed in claim 3 wherein:

said latch is equal to or greater in width than its length.

5. A container for containment and dispensing of beverages and liquid foods comprising:

a base portion having side walls, end walls, and a bottom;

a lid;

a groove on the interior surface of said lid;

an elastomeric seal within said groove for sealing between said lid and base portion;

a pivotal operating lever pivotally attached to a hook like latch for receipt by said lid, and wherein said operating lever is connected in part to brackets on a wall of said base portion;

said hook like latch having a width where it makes contact with said lid equal to or greater than its length; and, a spigot within one of said walls having a liquid dispensing valve operable by a handle connected thereto for dispensing liquids.

6. The container as claimed in claim 5 further comprising:

said base portion walls having an upper surface flange on the upper surfaces thereof.

7. The container as claimed in claim 5 further comprising:

a chamfer on the interior surface of said walls of said base portion.

8. A container for holding and dispensing beverages and liquid foods comprising:

a base portion having an interior for holding liquid foods having side walls and a base;

a lid for seating on top of said base portion;

a pivotal over center securement formed of a lever portion and a hook portion, wherein said lever portion is pivotally mounted on a wall of said base portion, and wherein the width of said hook portion where it engages the lid is equal to or greater than the length of said hook portion;

an elastomeric seal mounted in an interior groove of said lid; and, a liquid dispensing spigot mounted in at least one wall of said base portion for dispensing liquids from said container.

9. The container as claimed in claim 8 wherein:

said seal has a hollow interior cross-section.

10. The container as claimed in claim 8 wherein:

the top portion of the walls of said base portion have a chamfer.

11. The container as claimed in claim 10 wherein:

the top of the walls of said base portion have an upstanding flange.

12. The container as claimed in claim 11 further comprising:

handles molded to the exterior of said base portion.

13. The container as claimed in claim 8 further comprising:

said spigot mounted in at least one of said walls of said base portion has a valve connected to a handle for operating said valve to dispense liquids.

14. The container as claimed in claim 8 wherein:

said base portion and said lid have double walls with foam insulation therebetween.

* * * * *